United States Patent [19]

Tsang

[11] Patent Number: 5,056,780

[45] Date of Patent: Oct. 15, 1991

[54] FOLDING BILLIARD TABLE

[76] Inventor: Wu S. Tsang, P.O. Box 1-79, Taipei, Taiwan

[21] Appl. No.: 536,754

[22] Filed: Jun. 12, 1990

[51] Int. Cl.[5] ..... A63B 71/00

[52] U.S. Cl. ..... 273/3 R

[58] Field of Search ..... 273/30, 3 C, 5 R, 3 R; 108/115, 120, 129, 130, 131, 132

[56] References Cited

U.S. PATENT DOCUMENTS

| | | | |
|---|---|---|---|
| 122,830 | 1/1872 | Heyl | 273/5 R |
| 2,723,122 | 11/1955 | Jaysane | 273/30 |
| 3,744,812 | 7/1973 | Langhausen | 273/3 C |
| 3,988,020 | 10/1976 | Groves | 273/3 C |
| 4,089,522 | 5/1978 | Rock | 108/115 |
| 4,762,321 | 8/1988 | Chang | 273/30 |
| 4,815,395 | 3/1989 | Trueg | 108/115 |

FOREIGN PATENT DOCUMENTS

| | | | |
|---|---|---|---|
| 831890 | 1/1970 | Canada | 108/115 |

*Primary Examiner*—Theatrice Brown

*Attorney, Agent, or Firm*—Fleit, Jacobson, Cohn, Price, Holman & Stern

[57] ABSTRACT

A folding billiard table includes a billard table face, and a frame member supporting the billiard table face, a pair of main support legs rotatably mounted on eccentric portions of the frame member. A pair of foldable lateral support legs is disposed on one side of the main support legs, a pair of liftable and foldable lateral support legs is disposed on other side of the main support legs, and a pair of long and short linkages are disposed between the main support legs and liftable and foldable lateral support legs. When it is not used, the billiard table face can be turned upward, with the liftable and foldable lateral support legs raised, so that the billiard table face can be turned from a horizontal position to a vertical position to reduce the room occupied by the table.

6 Claims, 3 Drawing Sheets

FOLDING BILLIARD TABLE

BACKGROUND OF THE INVENTION

The present invention relates to a folding billiard table, and more particularly, to a billiard table in which, when it is not used, the table face thereof can be turned from a horizontal position to a vertical position to reduce the room occupied by the table.

A conventional billiard table generally has a table face with quite a large area of, for example 6×10 feet. Typically the whole table face is made from marble, while the support members of the table face are made from solid wood. Therefore, the weight of a conventional billiard table is typically quite large, and a common user can not move the billiard table by himself. Moreover, when it is not used, the billiard table is still located at its original position, and a large room space is occupied.

Therefore, an attempt has been made by the applicant to develop a folding billiard table which eliminates the above mentioned shortcomings existing in the prior art.

SUMMARY OF THE INVENTION

It is a primary object of this invention to provide a folding billiard table which can be manually rotated about a longitudinal axis and turned from a horizontal position to a vertical position. The main support legs of the billiard table are provided with casters so that the folded billiard table can be easily pushed to and stored in a corner to increase the available room for other use.

It is a further object of this invention to provide such a folding billiard table, wherein when the billiard table is stretched, to enhance the stability of the billiard table, the casters of the main support legs are braked and foldable support legs are also locked so that the folding billiard table can be used with the same stability as a conventional unfoldable billiard table.

BRIEF DESCRIPTION OF THE DRAWINGS

The present invention can be best understood through the following description and accompanying drawings, wherein.

DETAILED DESCRIPTION OF THE PREFERRED EMBODIMENTS

Figure 1:
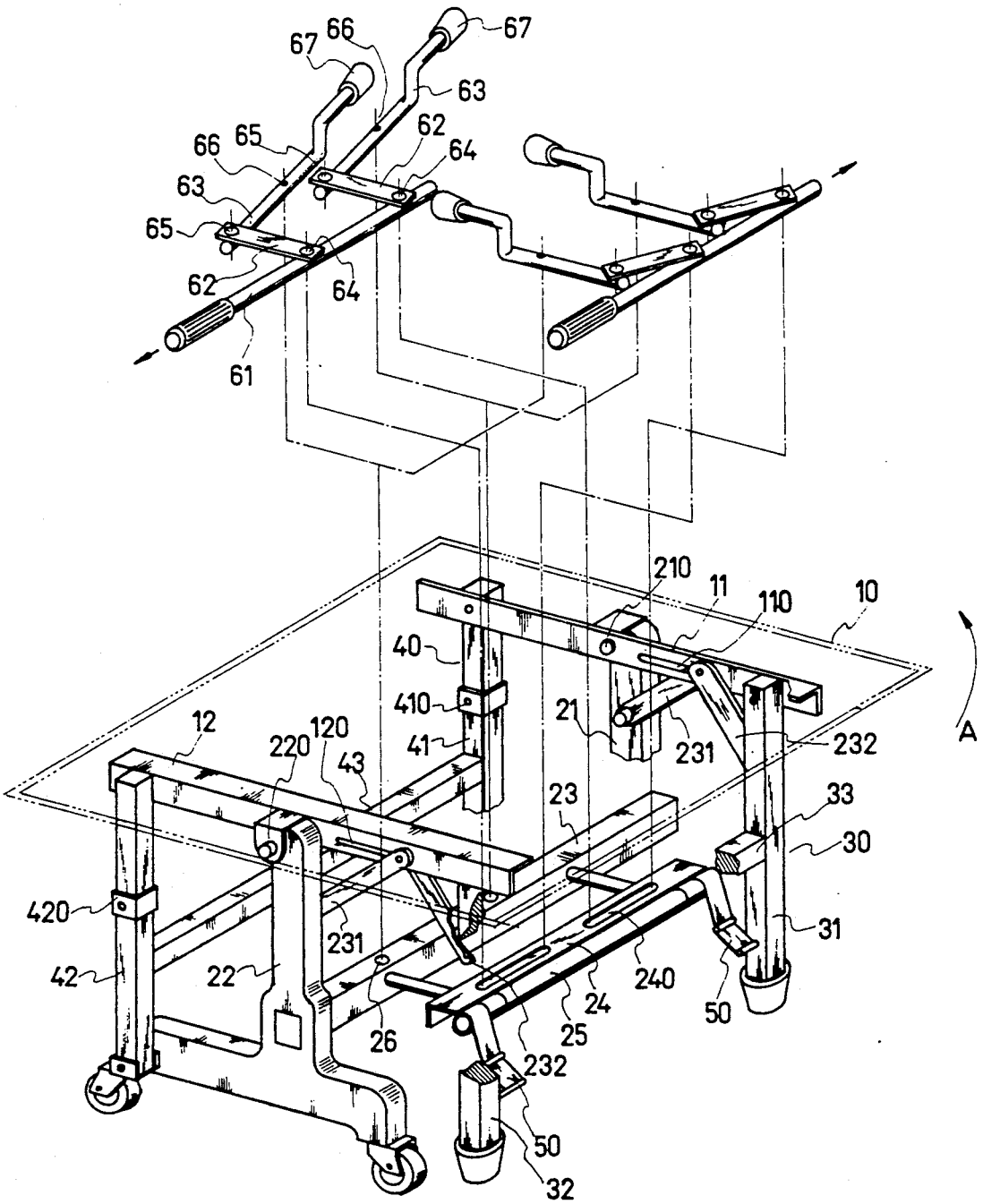
FIG. 1 is a perspective view of one preferred embodiment of this invention, in which the billiard table itself is not shown.

As shown in FIG. 1, the preferred embodiment of the folding billiard table of this invention includes:

a frame member 10 for supporting and reinforcing billiard table, having a transverse first support beam 11 and second support beam 12. The first and second support beams 11, 12 are respectively formed with long slots 110, 120.

A pair of middle main support legs 21, 22 have tops which are respectively rotatably mounted on the first and second support beams 11, 12 at an offset center, eccentric position for reducing folding force. Since the billiard table is rotated and folded from right to left, at top portions of main support legs 21, 22 are disposed turn heads 210, 220, facing the direction of rotation so that when the billiard table is folded, the billiard table can be brought thoroughly and smoothly perpendicular to the ground. Moreover, for the convenience of moving, the lower portions of main support legs are provided with casters having brakes so that when normally used, the billiard table is kept stationary.

A middle main support beam 23 is disposed between the main support legs 21, 22.

A pair of foldable lateral support legs 41, 42 are provided. The upper ends of the foldable lateral support legs are rotatably mounted on first ends of the first and second support beams 11, 12, and the lower ends of the legs are correspondingly rotatably mounted on lower portions of the pair of main support legs 21, 22. Two joint structures 410, 420 are respectively disposed at middle portions of the lateral support legs 41, 42.

A pair of foldable lateral support legs 31, 32, which can be lifted and folded. The upper ends of the lateral support legs 31, 32 are rotatably mounted on second ends of the first and second support beams 11, 12, while the lower ends of the lateral support legs 31, 32 contact the ground directly.

A pair of long and short linkages 231, 232, the first ends of which are respectively rotatably mounted on two main support legs 21, 22 and lateral support legs 31, 32, while the second ends of which are all pivoted in the long slots 110, 120 of the first and second support beams 11, 12, are provided. When folding the billiard table, the second ends of the linkages 231, 232 can freely slide along the long slots 110, 120.

A pair of hinges 50, 50 are provided. The first ends of the hinges are mounted on middle main support beam 23, and the second ends of the hinges are mounted on lower ends of the lateral foldable support legs 31, 32.

According to the above arrangement, the folding operation of this invention is as follows.

Figure 2:
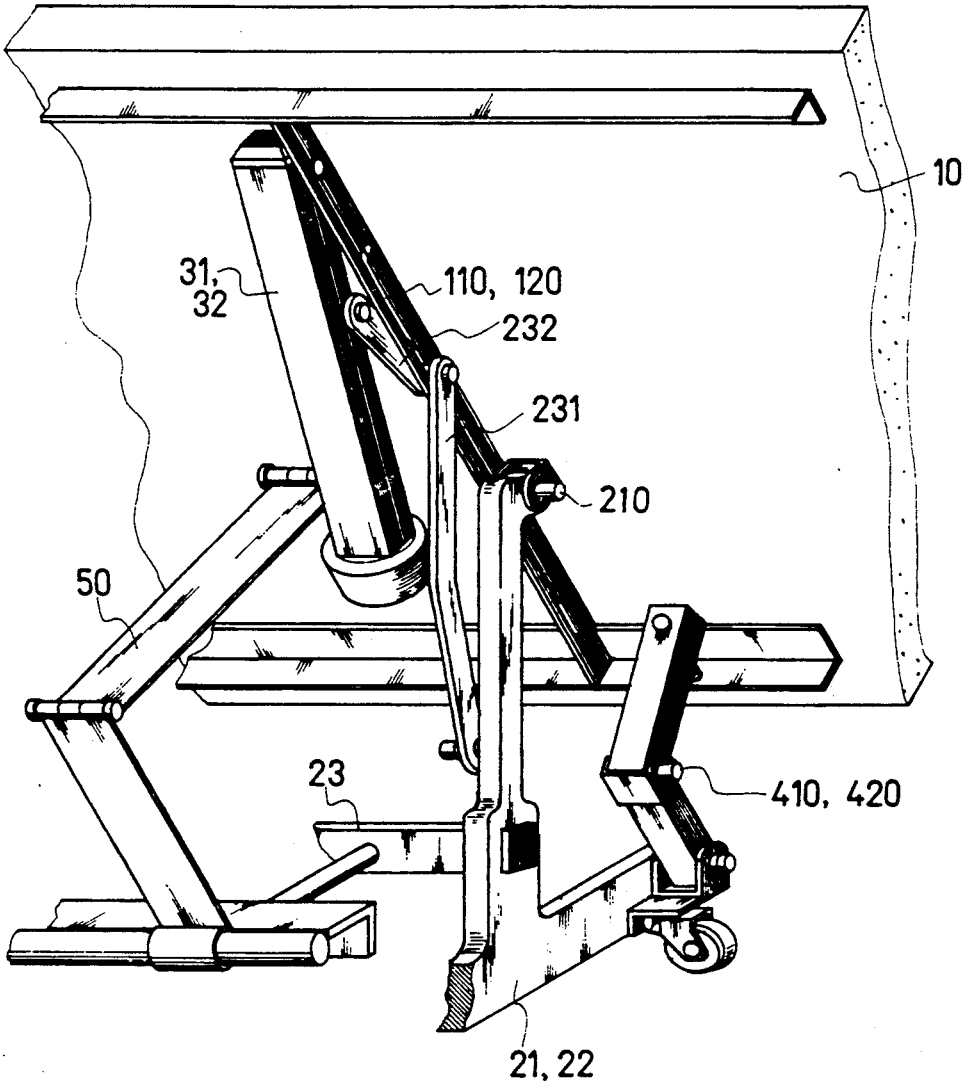
FIG. 2 shows the folding movement of this invention according to FIG. 1.

When folding, one only needs to upwardly turn the billiard table face in the direction indicated by arrow A so as to make the billiard table 10 rotate counterclockwise about the fulcrums of turns heads 210, 220 of main support legs 21, 22. At this time, the joints 410, 420 of the foldable lateral support legs 41, 42 start to fold as shown in FIG. 2, while the lateral support legs 31, 32 will leave the ground and gradually get close to the billiard table face 10. The pivot ends of long and short linkages 231, 232 will slide along long slots 110, 120 from a side hole thereof, toward central portions of the slots. Because the support point of the main support leg is near to the lower end of the folded billiard table, much strength is saved when turning, and after folding, the gravitation center of the billiard table is stable.

Figure 3:
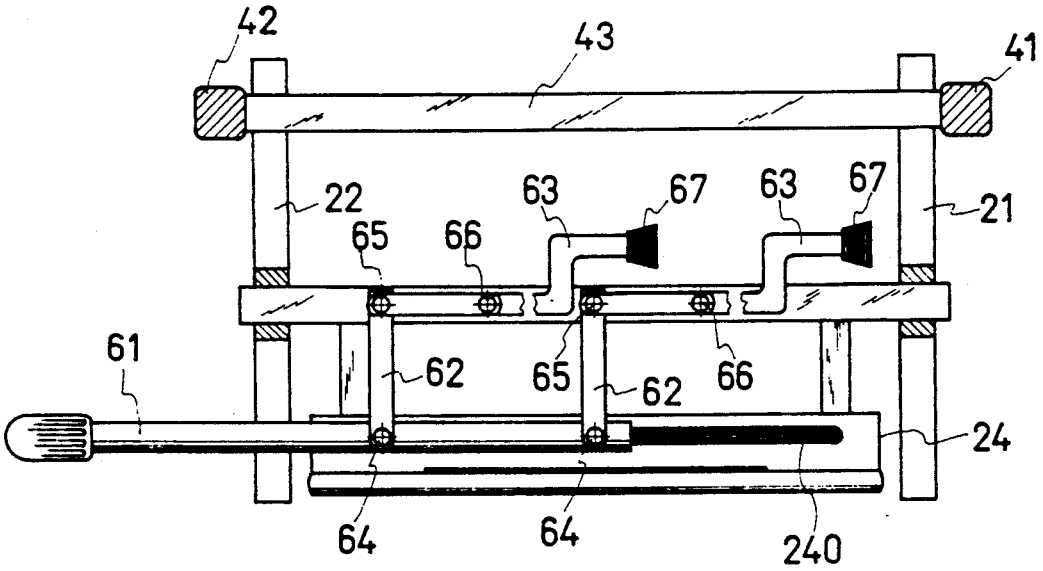
FIG. 3 shows a push/pull main bar as pulled back, and abutting support bars as retracted in the embodiment according to FIG. 1.
Figure 4:
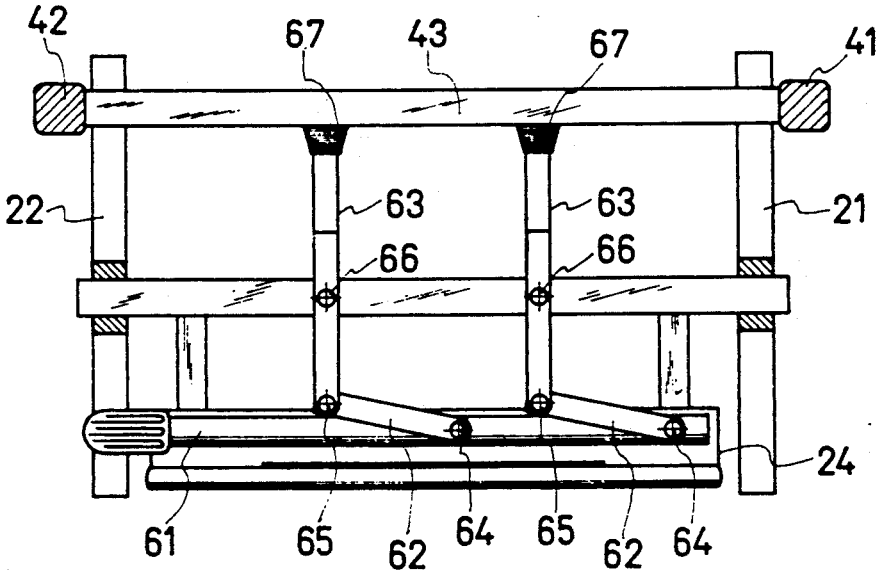
FIG. 4 shows that when not folded, the abutting support bars abut against foldable lateral support legs.

Moreover, in this invention, to permit the frame member to stably support the billiard table and keep the billiard table horizontal, a support member 24 is disposed beside the middle main support beam 23, as shown in FIG. 1. A push/pull bar means for locking support legs is disposed on the support member 24. The support member 24 is affixed to one side of the main support beam 23 by an angle iron bar, and two long slots 240—240 are formed on the support member. The push/pull bar means 60 includes a push/pull main bar 61 on which two linkages 62—62 are rotatably disposed corresponding to the long slots 240—240. Two abutting support bars 63—63 are respectively connected with the linkages 62—62 by pivots 65—65, and the abutting support bars 63—63 are respectively pivoted in two shaft holes 26—26 of the middle main support beam 23 by screw shafts 66—66 as shown in FIGS. 1 so that when pushing/pulling the push/pull main bar 61, through the linkages 62—62, the shoes 67—67 of the abutting support bars 63—63 will closely abut against a lateral support beam 43 disposed between the lateral support legs 41, 42 as shown in FIG. 4, or the shoes 67—67 will separate from the lateral support beam 43 and retract to a position near the middle support beam 23 as shown in FIG. 3. Accordingly, when the push-/pull bar 61 moves forward, the shoes 67—67 will abut closely against the support legs, making the same stable support the billiard table, and when the push/pull bar 61 is pulled back, the shoes 67—67 will retract, permitting the support leg to be folded.

Figure 5:
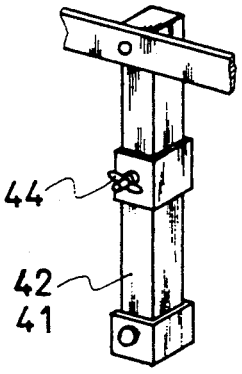
FIG. 5 shows another embodiment used to lock the foldable lateral support legs.

The aforesaid push/pull bar means 60 is only a preferred embodiment used to stabilize the support legs, and many other embodiments can be also used. For example, as shown in FIG. 5, the joint structures 420, 410 of the foldable lateral supports legs 41, 42 can be additionally provided with butterfly nut 44, and by means of loosening or tightening the butterfly nut 44, the support legs can be unlocked or stabilized.

According to the above description, the billiard table of this invention is identical to a conventional unfoldable billiard table when used, while when not used, the present billiard table can be easily folded to stand vertically so that the room can be used otherwise. After the table according to this invention is folded, the occupied room is reduced from approximately $5\times9=45$ square feet to approximately $1.5\times9=13.5$ square feet, and the folding operation is quite easy and convenient.

What is claimed is:

1. A folding billiard table, comprising:

a billiard table face with ball pockets;

a frame member disposed below said billiard table face so as to support the billiard table face, said frame member having at least a first support beam and a second support beam, said first support beam and said second support beam each being formed with a long slot;

a pair of main support legs, each of said main support legs having an upper end which is rotatably fixed to one of said first and second support beams of said frame member to support the same;

a middle main support beam extending between and attached to said main support legs;

a pair of foldable laterally disposed support legs, each of said pair of laterally disposed support legs having an upper end and a lower end, the upper end of each of said laterally disposed support legs being fixed to a first end of one of said first and second support beams, the lower end of each of said laterally disposed support legs being fixed to one side of one of said main support legs, each of said foldable laterally disposed support legs being provided with a foldable joint structure; and a pair of liftable and foldable laterally disposed support legs, each of said pair of liftable and foldable laterally disposed support legs having an upper end and a lower end, the upper end of each of said liftable and foldable laterally disposed support legs being rotatably fixed to a second end of one of said first and second support beams, so that when said billiard table face is turned upward, and said liftable and foldable lateral support legs are raised off the ground, each said foldable joint structure is bent, and each of said pair of liftable and foldable laterally disposed support legs is lifted gradually, and when said billiard table face is folded and stands vertically, each of said pair of liftable and foldable laterally disposed support legs is located closely adjacent to said billiard table face.

2. A folding billiard table as claimed in claim 1, wherein said frame member further includes:

a pair of short linkages, each having a first end and a second end, the first end of each of said pair of short linkages being rotatably fixed to one of said pair of liftable and foldable laterally disposed support legs, and the second end of each of said pair of short linkages being pivoted in the long slot of one of said first and second support beams; and a pair of long linkages, each having a first end and a second end, the first end of each of said pair of long linkages being pivoted in the long slot of one of said first and second support beams and rotatably connected with one of said short linkages at the second end of said one of said short linkages so that the first end of each of said long linkages and the second end of each of said short linkages can slide along the long slot of one of said first and second support beams, the second end of each of said pair of long linkages being rotatably fixed to one of said main support legs.

3. A folding billiard table as claimed in claim 1, and further comprising a push/pull bar means disposed on said middle main support beam and including at least one abutting support bar which is pivotable relative to said main support beam so as to abut against and lock at least one of said foldable laterally disposed support legs.

4. A folding billiard table as claimed in claim 3, and further comprising a support member disposed beside said middle main support beam, and wherein said push-/pull bar means includes:

a push/pull bar;

a pair of linkages, each of said linkages including a first end and a second end, each first end being pivoted by pivots on said push/pull bar, each of said pivots being freely slidable along a long slot formed in said support member disposed beside said middle main support beam; and a pair of abutting support bars, each having a first end, a second end, and a middle portion, the first end of each of said pair of abutting support bars being pivoted to the second end of one of said pair of linkages, the middle portion of each of said abutting support bars being further pivoted on said middle main support beam, the second end of each of the abutting support bars being provided with shoes for abutting said foldable lateral support legs.

5. A folding billiard table as claimed in claim 1, wherein a top portion of each of said pair of main support legs is rotatably and eccentrically fixed to a central portion of one of said first and second support beams.

6. A folding billiard table as claimed in claim 1, wherein each of said main support legs further has a lower end, the lower end of each of said main support legs being formed with transversely extending portions having two opposite ends, said opposite ends of said transversely extending portions being provided with casters for convenient moving.

* * * * *